United States Patent [19]

Dyck

[11] Patent Number: 4,834,292

[45] Date of Patent: May 30, 1989

[54] WATER SPRAY NOZZLE INCLUDING COMBINED INTAKE NOZZLE AND VALVE STRUCTURE

[75] Inventor: George J. Dyck, Saskatom, Canada

[73] Assignee: Raleigh Equities Ltd., Kelowna, Canada

[21] Appl. No.: 44,889

[22] Filed: Apr. 30, 1987

[51] Int. Cl.[4] ..... B05B 15/10; B05B 1/30; A62C 31/00

[52] U.S. Cl. ..... 239/446; 239/575; 239/579; 239/581.1; 239/204; 239/DIG. 1; 137/625.3

[58] Field of Search ..... 239/449, 446, 204, 205, 239/DIG. 1, 575, 593, 569, 579, 581.1, 285, 443; 251/209, 207; 137/625.3, 625.32

[56] References Cited

U.S. PATENT DOCUMENTS

| | | | |
|---|---|---|---|
| 1,181,145 | 5/1916 | Larson | 239/DIG. 1 |
| 2,634,163 | 4/1953 | Double | 239/DIG. 1 |
| 2,909,325 | 10/1959 | Hunter | 239/575 X |
| 2,935,266 | 5/1960 | Coleondro | 239/204 X |
| 2,943,798 | 7/1960 | Rienks | 239/204 X |
| 3,664,590 | 5/1972 | Knight | 239/DIG. 1 |
| 3,762,650 | 10/1973 | Radecki | 239/444 X |
| 4,353,506 | 10/1982 | Hayes | 239/206 |

FOREIGN PATENT DOCUMENTS

| | | | |
|---|---|---|---|
| 38643 | 2/1936 | Netherlands | 137/625.32 |

*Primary Examiner*—Andres Kashinkow
*Assistant Examiner*—Patrick N. Burkhart
*Attorney, Agent, or Firm*—Shenier & O'Connor

[57] ABSTRACT

A novel four passage intake nozzle and valve structure is provided for use with a specially designed, novel water deflection member to provide a pop-up water spray nozzle. The novel intake nozzle and valve structure includes a frusto-conical plug having an upper chamber and a lower portion provided with four specified longitudinally-extending passages surrounding a central core, each passage leading to an associated individual, unconnected, peripheral, longitudinally-extending passage of a four passage cylindrical conduit. Ports are arranged around the conical face of the frusto-conical plug and at at least two locations along its axial length, to communicate with the four specified passages passages. An apertured frusto-conical sleeve, is rotatably movably connected and is disposed about the frusto-conical valve plug, by means of a shaft disposed within the central, hollow core. The frusto-conical sleeve has a plurality of ports arranged around its conical face in an orientation identical to that of the ports in the frusto-conical plug and at at least one location along its axial length in an orientation similar to that of the ports of said frusto-conical plug, the leading edges of the ports therein being adapted to index precisely with the leading edges of selected ports of the valve plug. The upstream side thereof is connected to a water-conducting conduct, and the downstream side thereof is connected to a water spray. Upon rotation of the the frusto-conical sleeve, the shape of the spray pattern and/or the size of the spray area, may be selected and controlled at will.

23 Claims, 4 Drawing Sheets

FULL SQUARE SPRAY

1/4 SQUARE SPRAY

1/2 SQUARE SPRAY

3/4 SQUARE SPRAY

WATER SPRAY NOZZLE INCLUDING COMBINED INTAKE NOZZLE AND VALVE STRUCTURE

BACKGROUND OF THE INVENTION (i) Field of the Invention

This invention relates to a novel intake nozzle and valve structure for the control of the spray pattern of water sprinkler heads, to a novel water deflection head, and to novel pop-up water sprinklers including such novel intake nozzle and valve structure and novel water deflection head.

(ii) Description of the Prior Art

Underground sprinkler systems for lawns and gardens are well known installations. These systems, when connected to a source of pressured water, permit spraying of a determined area. Conventional sprinkling systems require many different spray patterns. State of the art sprinklers today have been designed to provide a full circle spray pattern, three-quarter circle spray pattern, one-half circle spray pattern or a one-quarter circle spray pattern, each such spray pattern specifically spraying a particular segment of a full circle. These state of the art sprinklers are not adjustable and moreover, they are always a function of a circle, even if the entire periphery is not usually curved.

Patents have issued which proposed to provide improvements in lawn sprinkling heads. Examples of such patents are: Canadian Pat. No. 773,969 patented Dec. 19, 1967 by G. J. Dyck; Canadian Pat. No. 873,764, patented June 22, 1971 by G. J. Dyck; U.S. Pat. No. 3,207,446, patented Sep. 21, 1965, by G. J. Dyck; U.S. Pat. No. 3,476,322, patented Nov. 4, 1969, by G. J. Dyck; and U.S. Pat. No. 3,517,886, patented June 30, 1970, by G. J. Dyck. These patents disclose sprinklers which provide either a one-half square spray pattern or a full square spray pattern, by the use of different individual sprinkler heads.

SUMMARY OF THE INVENTION (i) Aims of the Invention

In spite of these patents, there is still a need for a sprinkler which would provide a one-quarter spray pattern or a three-quarter spray pattern. There is also a need for a single spray head which can be adjusted to provide a one-quarter square spray pattern, one-half square spray pattern, a three-quarter square spray pattern or full square spray pattern, in which the area of such spray patterns could be varied at will.

One object then of this invention is to provide a pop-up water sprinkler including an improved intake nozzle and valve structure and an improved water deflection member, which can simply and easily be adjusted to provide a one-quarter square spray pattern, a one-half square spray pattern, a three-quarter square spray pattern or a full square spray pattern to adjust to the corners or sides of most lawns.

Another object of this invention is to provide both an improved intake nozzle and valve structure and an improved water deflection member having the means to adjust the size of the various selected one-quarter square spray pattern, one-half square spray pattern, three-quarter square spray pattern or full square spray pattern by a simple adjustment.

Yet another object of this invention is to provide both an improved intake nozzle and valve structure and an improved water deflection member providing laminar flow to all quadrants to result in equally square and controlled spray patterns.

(ii) Statements of Invention

By this invention an intake nozzle and valve structure is provided for use with a water deflection head, the intake nozzle and valve structure comprising: a frusto-conical valve plug having a upper chamber and a lower portion provided with four individual, unconnected, peripheral, longitudinally-extending passages surrounding a central, hollow core, each passage leading to an associated individual, unconnected, peripheral, longitudinally-extending passage of a four passage cylindrical conduit; a plurality of ports arranged around the conical face of the frusto-conical plug and at at least two locations along its axial length, one such port communicating with an associated one of the four individual, unconnected, peripheral, longitudinally-extending passages; a frusto-conical sleeve disposed about the frusto-conical plug and rotatably movable with respect thereto by means of a shaft disposed within the central, hollow core, the frusto-conical sleeve having a plurality of ports arranged around its conical face in an orientation identical to that of the ports in the frusto-conical plug and at at least one location along its axial length in an orientation similar to that of the ports therein being adapted to index precisely with the leading edges of selected ports of the frusto-conical valve plug; means for indirectly connecting the upstream side of the intake nozzle and valve structure to a water-conducting conduit; and means for connecting the downstream side of each of the four longitudinally-extending passages of the intake nozzle and valve structure to an associated quadrant of a four quadrant water deflection member; whereby upon rotation of the frusto-conical sleeve with respect to the frusto-conical valve plug, the shape of the spray pattern and/or the size of the spray area may be controlled at will to a full square spray pattern, a one-quarter square spray pattern, a one-half square spray pattern or a three-quarter square spray pattern through cooperation between the ports in the frusto-conical valve plug with the ports in said frusto-conical sleeve.

By another embodiment of this invention, a water sprinkler is provided including the above-described intake nozzle and valve structure in combination with a hollow cloverleaf insert for insertion into the upper chamber of the valve plug, the cloverleaf insert having four longitudinally-oriented slots spaced 90° apart; a four quadrant, water deflection member comprising: a shaft divided into four longitudinally-oriented quadrants by four radially-extending, longitudinally-oriented walls, the shaft being operatively connected to the hollow cloverleaf insert, with the longitudinally-oriented walls of the shaft mating with the longitudinally-oriented slots of the cloverleaf insert to provide four separate and distinct, longitudinally-oriented channels through the hollow cloverleaf insert; a deflection head capping the shaft, the deflection head having a lower frusto-conical face to deflect water separately channelled within the four, longitudinally-oriented quadrants; and manually operable means to control at least one of the shape of the spray pattern and the size of the spray area to a full square spray pattern, a one-quarter square spray pattern, a one-half square spray pattern or a three-quarter square spray pattern.

By another embodiment of this invention, a water deflection head is provided comprising: an hollow cloverleaf insert for insertion into a two-chamber valve plug, the lower chamber being divided into four individual, unconnected, peripheral longitudinally-extending passages the cloverleaf insert having four longitudinally-oriented slots spaced 90° apart; a deflection member comprising: a shaft divided into four longitudinally-oriented quadrants by four radially-extending, longitudinally-oriented walls, the shaft being operatively connected to the hollow cloverleaf insert, with the longitudinally-oriented walls of the shaft mating with the longitudinally-oriented slots of the cloverleaf insert to provide four separate and distinct, longitudinally-oriented channels through the hollow cloverleaf insert; a deflection head capping the shaft, the deflection head having a lower frusto-conical face to deflect water separately channelled within the four, longitudinally-oriented quadrants; and manually operable means to control at least one of the shape and the size of the spray area to a full square spray pattern, a one-quarter square spray pattern, a one-half square spray pattern or a three-quarter square spray pattern.

(iii) Other Features of the Invention

By a feature of the first embodiment of this invention, it is preferred that the central hollow core comprises a hollow cylindrical tube upstanding from the interior of the frustrum of the frusto-conical plug. The ports in the frusto-conical sleeve should be at two locations along the axial length of the frusto-conical sleeve.

By a feature of the first embodiment of this invention the frusto-conical plug preferably includes three upper ports disposed at the same axial position along its axial length, disposed 90° apart to provide a portion of the frusto-conical plug in which a 180° face is provided with ports, and in which a 180° face is free of ports, and a first, lower port, disposed 90° from the upper ports and at the centre of the 180° portion of the face of the frusto-conical core which is free of ports.

By a feature of the first embodiment of this invention, the frusto-conical sleeve preferably includes four upper ports. Three such ports are disposed at the same axial position along the axial length of the frusto-conical sleeve, disposed 90° apart and the fourth upper port is disposed 45° from two 90° spaced-apart ports, disposed at the same axial level as the three upper ports to provide a portion of the frusto-conical sleeve with a 180° face which contains ports, and with a 180° face free of ports. A first lower port is disposed 90° from the upper ports and at the centre of the 180° portion of the face of the frusto-conical sleeve which is free of ports, and one additional lower port is disposed at the same axial level as the first lower port and which is spaced 180° from the first lower port.

By a feature of the first embodiment of this invention, where the frusto-conical plug has a maximum diameter of 0.700", the upper ports may be 0.090"×0.129" in size. For a frusto-conical plug of a maximum diameter of 0.700", the lower port may be 0.125"×0.093" in size. For a frusto-conical plug of a maximum diameter of 0.700", the land distance between the upper and lower ports may be 0.150".

By a feature of the first embodiment of this invention, the ports in the frusto-conical sleeve are preferably the same size as the ports in the frusto-conical plug but they may be slightly larger as long as the cut-off sides, i.e. the leading edges are adapted to meet the port opening of the frusto-conical plug at the same time.

By a feature of the first embodiment of this invention, the frusto-conical plug may be integral with a cylindrical casing which is adapted to be vertically slidably secured to a water-conducting conduit, or it may be threadedly connected to a cylindrical casing which is likewise adapted to be vertically slidably secured to a water-conducting conduit. In this way, the intake nozzle and valve structure can become part of a "pop-up" water spray head.

By a feature of the first embodiment of this invention, the frusto-conical plug preferably also includes an upstanding cylindrical valve casing, which is either integral therewith or is threadedly connected thereto, to be operatively associated with a four quadrant water deflection head, so that the intake nozzle and valve structure along with the water deflection member forms part of a "pop-up" water spray head.

By a feature of another embodiment of this invention, each of the four longitudinally-oriented quadrants situated below the deflection head is preferably capped by a portion of a solid cylinder. The water deflection member preferably includes: a top flange provided with a central bore including a countersunk concentric portion; a rotatably-mounted selection disc having a central aperture in the shape of a geometric figure for nonrotational cooperation with the end of a shaft of the apertured member, e.g. the end of the shaft of the frusto-conical sleeve having the same geometric shape; and a screw passing through the selection disc, to hold the selection disc to the top of the shaft. The cross-section of the shaft may be either square or splined.

By a feature of another embodiment of this invention, each of the four longitudinally-oriented quadrants which contains the deflection member passes through a hollow cloverleaf insert in the form of a four sectional cloverleaf at its upper end. In this way each longitudinally-oriented quadrant of the deflection member together with one longitudinally-oriented channel through the hollow cloverleaf constitutes an orifice which controls the water to be deflected by the deflection member to spray a respective one-quarter square pattern.

By a feature of another embodiment of this invention, the water sprinkler includes an apertured laminar flow sealing washer disposed between the hollow cloverleaf insert and the shaft of the deflection member, to provide laminar flow control through four separate sections of the hollow cloverleaf insert. Where the apertured member is a frusto-conical sleeve, the laminar washer has four apertures therethrough and both the shape of the spray pattern and the size of the spray area are controlled by indexing of the ports in the frusto-conical valve plug and in the frusto-conical sleeve.

By a feature of another embodiment of this invention, a hold down sleeve may be provided for threadedly interconnecting the upper face of the hollow cloverleaf insert to an upper externally threaded portion of the valve plug. As well, the water sprinkler may be threadedly connected to a cylindrical casing which is adapted to be slidably secured to a water-conducting conduit.

By a feature of another embodiment of this invention, the water deflection head preferably includes an apertured laminar flow sealing washer disposed between the hollow cloverleaf insert and the shaft of the deflection member, to provide laminar flow control through four separate sections of the cloverleaf insert. The four longitudinally-oriented quadrants below the deflection cap are each capped by a portion of a solid cylinder.

The water deflection member includes: a top flange provided with a central bore including a countersunk concentric portion; a rotatably-mounted selection disc having a central aperture in the shape of a geometric figure for non-rotational cooperation with the end of a shaft, having the same geometric shape; and a screw passing through the selection disc, to hold the selection disc to the top of the shaft. The cross-section of the shaft may be square or splined.

BRIEF DESCRIPTION OF THE DRAWINGS

In the accompanying drawings.

Figure 2:
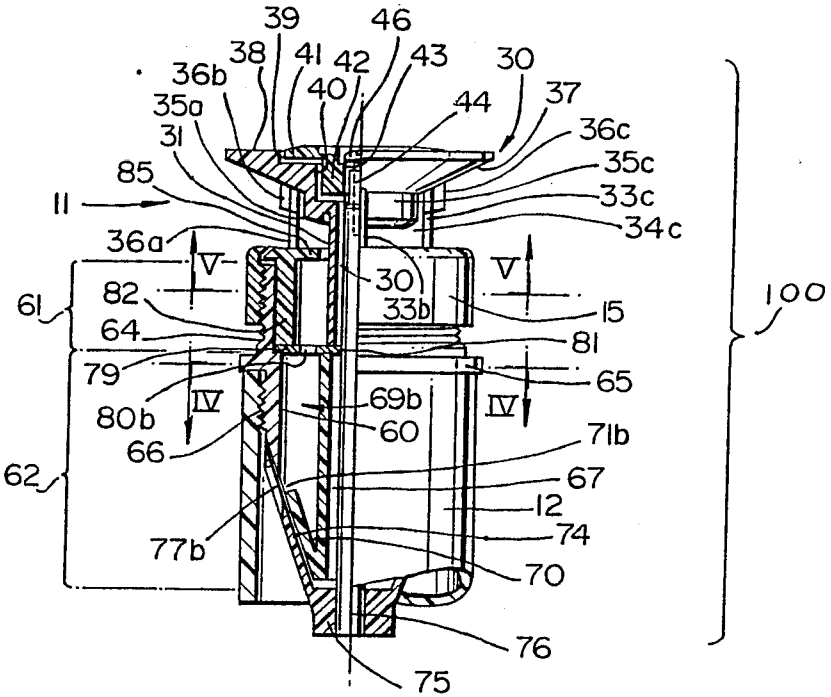
FIG. 2 is a central longitudinal view, partly in cross-section and partly in elevation of the intake nozzle and valve structure of one embodiment of the invention and the water deflection member of another embodiment of this invention for use with the pop-up nozzle of a first embodiment of this invention as shown in FIG. 1.
Figure 1:
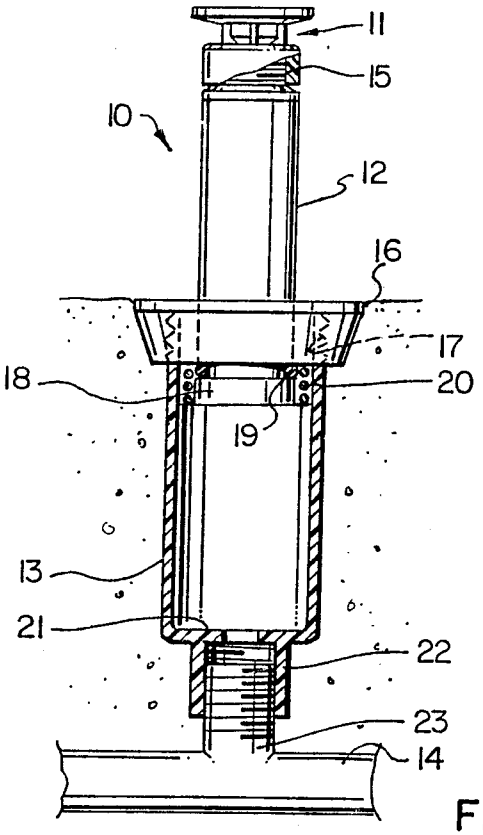
FIG. 1 is a side elevational view, partly in cross-section, of the pop-up nozzle of one embodiment of this invention, incorporating the intake nozzle and valve structure of one embodiment of this invention and the water deflection head of another embodiment of this invention in its upper, water spraying mode.
Figure 3:
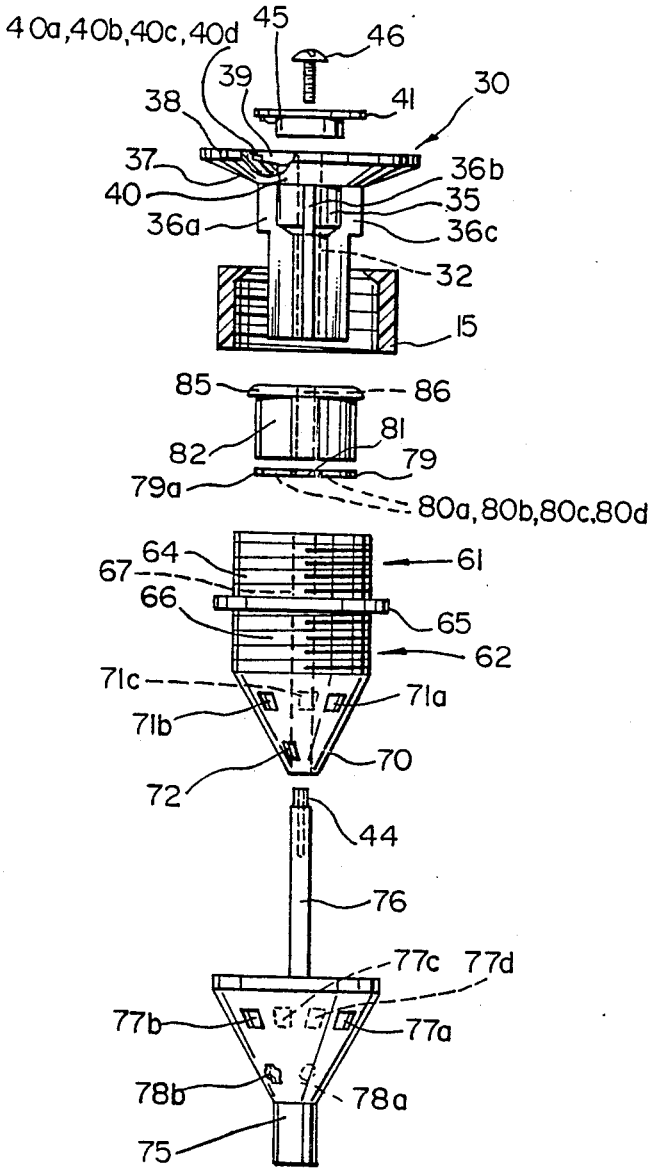
FIG. 3 is an exploded view of the intake nozzle and valve structure of the embodiment of this invention and of the water deflection member of the embodiment of this invention shown in FIG. 2.

DESCRIPTION OF PREFERRED EMBODIMENTS (i) Description of FIG. 1

FIG. 1 shows the pop-up sprinkler head 10 of one embodiment of the present invention including a sprinkler cap 11 having a casing 12 operatively associated with, and vertically slidably disposable within, a conventional housing 13 connected to a water supply pipe 14. Housing 13 is threadedly secured, in the conventional manner, by threaded coupling 22 onto threaded nipple 23 upstanding from water supply pipe 14. The "pop-up" sprinkler head 10 includes a threaded hold-down sleeve 15 to secure a hollow cloverleaf insert (not seen but which will be described later) to the intake nozzle and valve structure (not seen but also to be described later). The intake nozzle and valve structure (not seen) is threadedly connected to the casing 12 by means to be described later. In addition, as is conventional in the art, the "pop-up" sprinkler head 10 includes an internally threaded cap 16 threadedly secured to the externally threaded end 17 of the housing 13. The casing 12 is freely slidably mounted within the housing 13, the upward movement of the casing 12 being limited by upper abutting surfaces of a flange 18 against a suitable seal 19, e.g. of rubber. A coil spring 20 helps to urge the casing 12 downwardly. Such downward movement is limited by the sprinkler cap 11 being flush with the top of the threaded cap 16 and by the lower surface of the flange 18 resting on the upper surface of the interior base 21 of the housing 13.

(ii) Description of FIGS. 2-5

FIGS. 2-5 illustrate more clearly the construction of the intake nozzle and valve structure 100 of one embodiment of the invention and of the water deflection member 11 of another embodiment of this invention, used in a so-called "pop-up" sprinkler head 10 of yet another embodiment of the present invention.

The intake nozzle and valve structure 100 includes as its heart a valve plug 60. Valve plug 60 is divided into an upper chamber 61 and a lower section 62. Upper chamber 61 is provided with four 90° spaced-apart internal slots 63 and with external threads 64 by which hold-down sleeve 15 may be threadedly connected to the valve plug 60. Lower section 62 is separated from upper chamber 61 by an external ring 65. Lower section 62 below ring 65 is provided with external threads 66 by which the valve plug 60 may be theadedly connected to the casing 12.

The lower section 62 is provided with a longitudinally extending central bore 67 from which radiates four radial, longitudinally-extending, dividing walls **68*a*, 68*b*, 68*c*, and 68*d*, to divide the lower section 62 into four separate and distinct longitudinally-extending, water-flow channels 69*a*, 69*b*, 69*c* and 69*d*. The lower section 62 terminates in a frusto-conical portion 70, which is provided with three upper rectangular ports 71*a*, 71*b* and 71*c*, each communicating exclusively with its associated flow channel 69*a*, 69*b* and 69*c*, and a single, lower, rectangular port 72 which communicates exclusively with its associated flow channel 69*d*. To facilitate the access of the apertures with the flow channels, the flow channels are each provided with internal longitudinally-extending slots 73 within the internal face of the lower section 62**.

A frusto-conical hollow sleeve 74, having a lower cylindrical base 75 surrounds the frusto-conical portion 70. A central shaft 76 is either secured within, or is integrally formed with, the hollow cylindrical base 75 and projects upwardly for a purpose to be described hereinafter. Hollow, frusto-conical sleeve 74 is provided with four upper rectangular ports **77*a*, 77*b*, 77*c* and 77*d* spaced 45°, 180°, 90° and 90° apart, which are adapted selectively to register with ports 71*a*, 71*b* and 71*c* in the frusto-conical portion 70, and two lower holes 78*a* and 78*b*, spaced 180° apart and aligned with, but axially spaced below, one of the upper apertures 71*d*, and which are adapted selectively to register with lower aperture 72 in frusto-conical portion 70**.

Disposed within upper chamber 61 is an apertured, laminar flow sealing washer 79 provided with four 90° spaced-apart external ribs **79*a* which are accommodated in slots 63 in the inner wall of upper chamber 61, and four apertures 80*a*, 80*b*, 80*c* and 80*d*, each communicating with its associated flow channel 69*a*, 69*b*, 69*c* and 69*d*, to assure laminar water flow. The washer 79 is provided with a central bore 81, through which upstanding central shaft 76** projects.

Disposed atop washer 79 is a hollow cloverleaf insert 82 having four 90° spaced-apart external ribs 83 which are accomodated in the aforesaid slots 63, and four 90° spaced-apart internal arcuate indents **84*a*, 84*b*, 84*c*** and 84*d*, each communicating with an associated aperture 80*a*, 80*b*, 80*c* and 80*d* in washer 79.

The upper face of hollow, cloverleaf insert 82 includes a flange 85. Flange 85 is provided with a central bore cloverleaf-shaped bore 86 from which extend 90° spaced-apart rectangular slots 87*a*, 87*b*, 87*c* and 87*d*.

Accommodated within upper chamber 61 by means of slots 87*a*, 87*b*, 87*c* and 87*d* a sprinkler cap 11. Sprinkler cap 11 includes a lower stem 31 in the form of a central bore 32 through which upstanding central shaft 76 projects from which radiates four 90° spaced-apart longitudinally-extending major ribs 33*a*, 33*b*, 33*c* and 33*d* to form four longitudinally-extending channel-forming quadrants 34*a*, 34*b*, 34*c* and 34*d*. Each quadrant 34*a*, 34*b*, 34*c* and 34*d* terminates in its own partial cylindrical water deflection abutment 35*a*, 35*b*, 35*c* and 35*d*. Likewise, each major rib 33*a*, 33*b*, 33*c* and 33*d* terminates in its own minor but wider, radial, longitudinally-extending partial wall 36*a*, 36*b*, 36*c* and 36*d*.

Stem 31 terminates in a cap comprising a frusto-conical lower surface 37 and a rim 38.

The upper face of rim 38 is provided with a shallow well 39 and a concentric countersunk depression 40. The upper surface of well 39 along the periphery thereof is provided with a plurality of spaced-apart indexing projections 40*a*, 40*b*, 40*c* and 40*d*. The peripheral surface of the rim 38 surrounding the well 39 is provided with a plurality of indexing members to indicate what spray pattern has been selected. Within countersunk depression 40 is disposed a selection disc 41 whose lower stem 42 is provided with a central square aperture 43 to mate with the square end 44 of upstanding central shaft 76. The selection disc 44 also includes a depending indexing pin 45 to cooperate with indexing projections 40*a*, 40*b*, 40*c* and 40*d* to aid in the proper selection of the spray patterns. The selection disc and the water deflection head 30 are maintained in assembled condition by means of screw 46 threaded into the tapped square upper end 44 of the upstanding central shaft 76.

In one embodiment of the invention, the frusto-conical plug 61 may be 0.700" in maximum diameter and may be provided with three upper ports 71*a*, 71*b* and 71*c* which may be 0.090"×0.129" in size and which are spaced 90° apart at the same axial length level of the frusto-conical termination 70. This configuration thus provides three ports 71*a*, 71*b* and 71*c* in a 180° conical face of the frusto-conical termination 70 and a 180° conical face free of ports. It is also provided with one lower port 72 which may be 0.125"×0.093" in size, spaced 90° from the last upper port 71*a*, 71*b* or 71*c* or 180° from the central upper port 71*d*, and thus is disposed in the centre of the 180° region of the frusto-conical termination 70 which does not have any upper ports. Each of the ports 71*a*, 71*b*, 71*c* and 72 communicates with its associated one of the four channels 69*a*, 69*b*, 69*c* and 69*d*.

The frusto-conical hollow sleeve 74 includes four upper ports 77*a*, 77*b*, 77*c* and 77*d* which are identical in orientation to the upper ports 71*a*, 71*b* and 71*c* of the frusto-conical termination 70 but which may be either identical in size or larger provided the leading edge of the sleeve port can index the leading edge of an associated valve plug port. The frusto-conical hollow sleeve 74 may include one or two lower ports 78*a*, 78*b* which are 180° spaced-apart, which may be identical in orientation to the lower port 72 of the frusto-conical temination 70.

Figure 4:
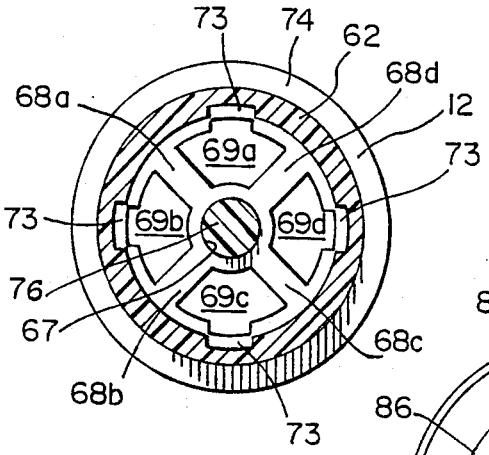
FIG. 4 is a transverse section along the line IV—IV of FIG. 2 showing the configuration of the clover leaf insert.

FIG. 4 shows the interior structure of the hollow frusto-conical termination 70, which shows four separate and distinct and non-interconnected, longitudinally-extending peripheral channels 69*a*, 69*b*, 69*c*, and 69*d* divided by respective walls 68*a*, 68*b*, 68*c* and 68*d* to provide up to four separate and distinct potential flow paths for the water. As described before, each of the channels 69*a*, 69*b*, 69*c* and 69*d* communicate with an associated one of the ports 71*a*, 71*b*, 71*c* and 72 of the frusto-conical termination 70. In addition, this Figure shows the hollow upstanding central bore 67 and the central hollow shaft 76.

Figure 5:
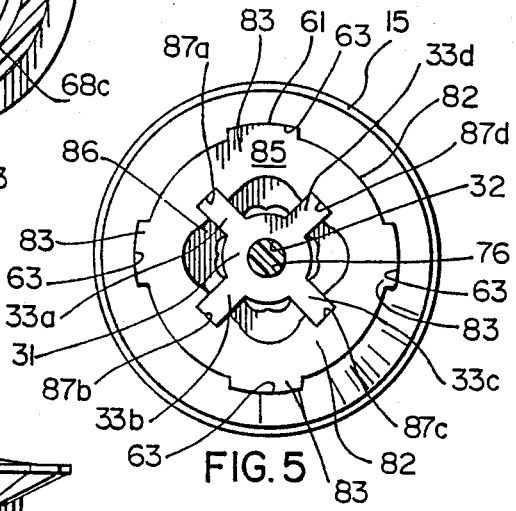
FIG. 5 is a transverse section along the line V—V of FIG. 2, showing the configuration of the intake nozzle and valve structure.

FIG. 5 shows the cross-section of the interrelationship of the hollow cloverleaf insert 82 and the stem 31 of the water deflection member 11. It is seen that, when the stem 31 of the water deflection member 11 is mated with the hollow cloverleaf insert 82 having its ribs 33*a*, 33*b*, 33*c* and 33*d* fit into slots 87*a*, 87*b*, 87*c* and 87*d*, there are four separate and distinct flow channels formed which are extensions of the aforementioned flow channels 69*a*, 69*b*, 69*c* and 69*d*.

Figure 6:
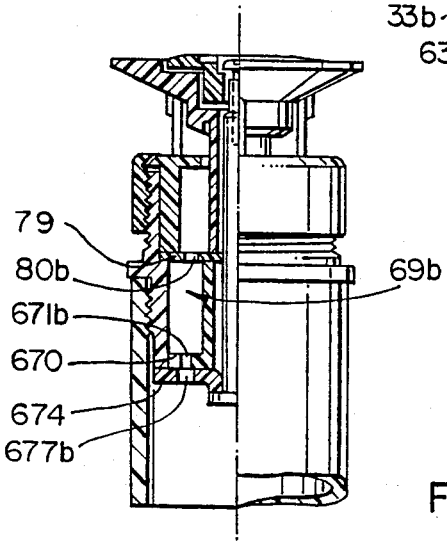
FIG. 6 is a central longitudinal view, partly in cross-section and partly in elevation of the intake nozzle and valve structure of another embodiment of this invention and the water deflection member of another embodiment of this invention, for use with the pop-up nozzle of a first embodiment of this invention as was shown in FIG. 1.

(iii) Description of FIG. 6

FIG. 6 shows another embodiment of the intake nozzle and valve structure of one aspect of the invention. In this embodiment, the frusto-conical termination 70 and the frusto-conical sleeve 74 are replaced by functionally-equivalent structure. Thus, the lower section 62 terminates in a disc 670 which is provided with four flow through ports 671*a*, 671*b*, 671*c* and 67*d*. The frusto-conical sleeve is replaced by a flat indexing disc 674 provided with four equally spaced ports 677*a*, 677*b*, 677*c* and 677*d* which index precisely with the four ports 671*a*, 671*b*, 671*c* and 671*d*.

OPERATION OF PREFERRED EMBODIMENTS (i) Operation of Embodiment of FIGS. 2–5

Figure 7A:
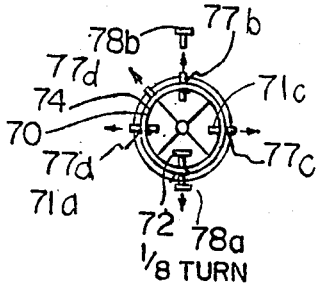
FIGS. 7A, 7B, 7C and 7D are schematic cross-sectional views of the relative orientation between the ports in the frusto-conical plug and the ports in the frusto-conical sleeve to provide the various spray patterns.
Figure 7B:
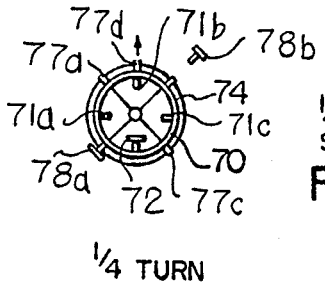
Figure 7C:
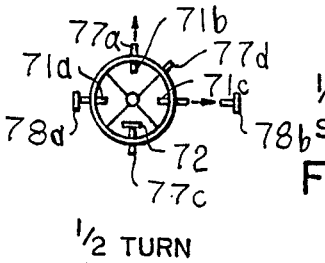
Figure 7D:
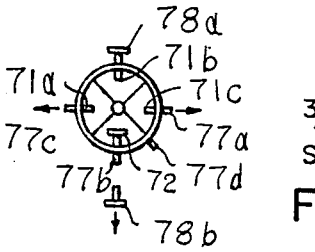

To control the shape of the spray pattern in the embodiment shown in FIGS. 2–5, i.e. full square spray pattern, three-quarter square spray pattern, half square spray pattern one-quarter square spray pattern, the frusto-conical hollow sleeve 74 is rotated by means of the selection disc 41 so that selected upper ports 77*a*, 77*b*, 77*c* and 77*d* of the frusto-conical hollow sleeve 74 register with selected ports 71*a*, 71*b*, 71*c* and 72 of the frusto-conical termination 70 as shown in FIGS. 7A–7D. As seen in FIG. 7A, a full turn indexes, either partially or completely, ports 77*a*, 77*b*, 77*c* and 78*a* or 78*b* with ports 71*a*, 71*b*, 71*c* and 72, to provide a full square spray pattern. As seen in FIG. 7B, a one-eight turn indexes, either partially or completely, port 77*d* with port 71*b*, to provide a one-quarter square spray pattern. As seen in FIG. 7C, a one-quarter turn indexes, either partially or completely, ports 77*b* and 77*a* with ports 71*c* and 71*b*, to provide a one-half square spray pattern. As seen in FIG. 7D, a one-half turn indexes, either partially or completely, ports 77*a*, 78*d* and 77*c* with ports 71*c*, 72 and 71*a*, to provide a three-quarter square spray pattern.

To control the size of the area of the spray patterns, whether they be a full square spray pattern, one-quarter square spray pattern, one-half square spray pattern or a three-quarter square spray pattern, the indexing of the ports in the frusto-conical sleeve 58 to the ports in the frusto-conical plug 61 is increased. Thus, the more completely the ports are indexed, i.e. the more the port is opened, the greater volume of water can flow through the ports, and so the greater the size or area of the spray pattern.

(ii) Operation of Embodiment of FIG. 6

The embodiment of FIG. 6 is operated by means of disc 674 and apertured washer 79. The purpose of the disc 674 is to adjust the flow of water from full flow to essentially zero flow, thereby adjusting the size only of any one of the previously selected one-quarter, one-half, three-quarter or full square spray patterns. The selection of the spray pattern is made by using an apertured washer 79 having one, two, three or four apertures, to provide one-quarter, one-half, three-quarters or full square spray patterns, respectively.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What I claim is:

1. An intake nozzle and valve structure for use with a water deflection member, said intake nozzle and valve structure comprising: a frusto-conical valve plug having a upper chamber and a lower portion provided with four individual, unconnected, peripheral, longitudinally-extending passages surrounding a central, hollow core, each passage leading to an associated individual, unconnected, peripheral, longitudinally-extending passage of a four passage cylindrical conduit; a plurality of ports arranged around the conical face of said frusto-conical plug and at least two locations along its axial length, each said port communicating with an associated one of said four individual, unconnected, peripheral, longitudinally-extending passages; a frusto-conical sleeve disposed about said frusto-conical valve plug and rotatably movably mounted with respect thereto by means of a shaft disposed within said central, hollow core, said frusto-conical sleeve having a plurality of ports arranged around the conical face of said frusto-conical sleeve in an orientation identical to that of said ports in said frusto-conical plug and at at least one location along its axial length in an orientation similar to that of the ports of said frusto-conical valve plug, the leading edges of said ports therein being adapted to index precisely with the leading edges of selected ports of said frusto-conical valve plug; means for indirectly connecting the upstream side of said intake nozzle and valve structure to a water-conducting conduit; and means for connecting the downstream side of each of said four longitudinally-extending passages of said intake nozzle and valve structure to an associated quadrant of a four quadrant water deflection head; whereby upon rotation of said frusto-conical sleeve with respect to said frusto-conical valve plug, the shape and size of the spray area may be controlled at will to a full square spray pattern, a one-quarter square spray pattern, a one-half square spray pattern or a three-quarter square spray pattern through cooperation between said ports in said frusto-conical valve plug with said ports in said frusto-conical sleeve.

2. The intake nozzle and valve structure of claim 1 wherein said central hollow core comprises a hollow cylindrical tube upstanding from the interior of the frustrum of said frusto-conical plug.

3. The intake nozzle and valve structure of claim 1 wherein said ports in said frusto-conical sleeve are at two locations along the axial length of said frusto-conical sleeve.

4. The intake nozzle and valve structure of claim 1 wherein said frusto-conical valve plug includes three upper ports disposed at the same axial position along its axial length, disposed 90° apart to provide a conical face of said frusto-conical plug with a 180° face provided with ports, and with a 180° face free of ports, and a single, lower port, disposed 90° from said upper ports and at the centre of the 180° face of said conical face of said frusto-conical plug which is free of ports.

5. The intake nozzle and valve structure of claim 1, wherein said frusto-conical sleeve includes four upper ports; wherein three said ports are disposed at the same axial position along the axial length of said frusto-conical sleeve, disposed 90° apart and wherein the fourth upper port is disposed 45° from two 90° spaced-apart ports, disposed at the same axial level as said three upper ports to provide a portion of said frusto-conical sleeve with a 180° face which contains ports and with a 180° face free of ports; wherein a first lower port is disposed 90° from said upper ports and at the centre of the 180° portion of the face of said frusto-conical sleeve which is free of ports; and wherein one additional lower port is disposed at the same axial level as said first lower port and which is spaced 180° from said first lower port.

6. The intake nozzle and valve structure of claim 1, wherein said frusto-conical plug is integral with a cylindrical casing which is adapted to be slidably secured to a water-conducting conduit.

7. The intake nozzle and valve structure of claim 1, wherein said frusto-conical plug is threadedly connected to a cylindrical casing which is adapted to be slidably secured to a water-conducting conduit.

8. The intake nozzle and valve structure of claim 1, including an upstanding cylindrical valve casing adapted to be operatively associated with a water deflection member.

9. The intake nozzle and valve structure of claim 8 wherein said upstanding cylindrical valve casing is integral therewith.

10. The intake nozzle and valve structure of claim 8 wherein said upstanding cylindrical valve casing is threadedly connected thereto.

11. A water sprinkler comprising the combination of the intake nozzle and valve structure of claim 1 with (a) an hollow cloverleaf insert for insertion into the upper chamber of said valve plug, said cloverleaf insert having four longitudinally-oriented slots spaced 90° apart;

(b) a four quadrant, water deflection member comprising:

(i) a shaft divided into four longitudinally-oriented quadrants by four radially-extending, longitudinally-oriented walls, said shaft being operatively connected to said hollow cloverleaf insert, with said longitudinally-oriented walls of said shaft mating with said longitudinally-oriented slots of said cloverleaf insert to provide four separate and distinct, longitudinally-oriented channels through said hollow cloverleaf insert; and (ii) a deflection head capping said shaft, said deflection head having a lower frusto-conical face to deflect water separately channelled within said four, longitudinally-oriented quadrants; and (c) manually operable means to control at least one of the shape of the spray pattern and the size of the spray area to a full square spray pattern, a one-quarter square spray pattern, a one-half square spray pattern or a three-quarter square spray pattern.

12. The water sprinkler of claim 11 including an apertured laminar flow sealing washer disposed between said hollow cloverleaf insert and said shaft of said deflection member, to provide laminar flow control through four separate sections of said hollow cloverleaf insert.

13. The water sprinkler of claim 11 wherein each of said four longitudinally-oriented quadrants situated below said deflection head is capped by a portion of a solid cylinder.

14. The water sprinkler of claim 11, wherein said water deflection member includes: a top flange provided with a central bore including a countersunk concentric portion; a rotatably-mounted selection disc having a central aperture in the shape of a geometric figure for non-rotational cooperation with the end of a shaft having the same geometric shape; and a screw passing through said selection disc, to hold said selection disc to the top of said shaft.

15. The water sprinkler of claim 11 wherein each of the four longitudinally-oriented quadrants which contains said deflection member passes through a hollow cloverleaf insert in the form of a four sectional cloverleaf at its upper end; whereby each longitudinally-oriented quadrant of the deflection member together with one longitudinally-oriented channel through said hollow cloverleaf constitutes an orifice which controls the water to be deflected by the deflection member to spray a respective one-quarter square pattern.

16. The water deflection head of claim 11 wherein the cross-section of the shaft of the frusto-conical sleeve is square or splined.

17. The water sprinkler of claim 11 including a hold down sleeve threadedly interconnecting the upper face of said hollow cloverleaf insert to an upper externally threaded portion of said frusto-conical plug.

18. The water sprinkler of claim 11 threadedly connected to a cylindrical casing which is adapted to be slidably secured to a water-conducting conduit.

19. A water deflection head, comprising:

(a) an hollow cloverleaf insert for insertion into the upper chamber of a two chamber valve plug, the lower chamber being divided into four individual, unconnected, peripheral longitudinally-extending passages, said cloverleaf insert having four longitudinally-oriented slots spaced 90° apart;

(b) a deflection member comprising:

(i) a shaft divided into four longitudinally-oriented quadrants by four radially-extending, longitudinally-oriented walls, said shaft being operatively connected to said hollow cloverleaf insert, with said longitudinally-oriented walls of said shaft mating with said longitudinally-oriented slots of said cloverleaf insert to provide four separate and distinct, longitudinally-oriented channels through said hollow cloverleaf insert; and (ii) a deflection head capping said shaft, said deflection head having a lower frusto-conical face to deflect water separately channelled within said four, longitudinally-oriented quadrants; and (c) manually operable means to control at least one of the shape of the spray pattern and the size of the spray area to a full square spray pattern, a one-quarter square spray pattern, a one-half square spray pattern or a three-quarter square spray pattern.

20. The water deflection head of claim 19 including an apertured laminar flow sealing washer disposed between said hollow cloverleaf insert and said shaft of said deflection member, to provide laminar flow control through four separate sections of said cloverleaf insert.

21. The water deflection head of claim 19 wherein said four longitudinally-oriented quadrants below said deflection cap is each capped by a portion of a solid cylinder.

22. The water deflection head of claim 19 wherein said water deflection member includes: a top flange provided with a central bore including a countersunk concentric portion; a rotatably-mounted selection disc having a central aperture in the shape of a geometric figure for non-rotational cooperation with the end of a shaft having the same geometric shape; and a screw passing through said selection disc, to hold said selection disc to the top of said shaft.

23. The water deflection head of claim 22 wherein the cross-section of said shaft is square or splined.

* * * * *